US012528611B2

(12) United States Patent
Peccetti

(10) Patent No.: US 12,528,611 B2
(45) Date of Patent: Jan. 20, 2026

(54) MACHINE FOR WRAPPING ONE OR MORE BUNDLES WITH STRETCH FILM FROM A REEL WITH CONTINUOUS SUCTION

(71) Applicant: COLINES S.P.A., Novara (IT)

(72) Inventor: Eraldo Peccetti, Novara (IT)

(73) Assignee: COLINES S.P.A., Novara (IT)

( * ) Notice: Subject to any disclaimer, the term of this patent is extended or adjusted under 35 U.S.C. 154(b) by 0 days.

(21) Appl. No.: 18/876,813

(22) PCT Filed: Jun. 12, 2023

(86) PCT No.: PCT/IB2023/056029

§ 371 (c)(1),
(2) Date: Dec. 19, 2024

(87) PCT Pub. No.: WO2023/248051

PCT Pub. Date: Dec. 28, 2023

(65) Prior Publication Data

US 2025/0376283 A1 Dec. 11, 2025

(30) Foreign Application Priority Data

Jun. 20, 2022 (IT) ..... 102022000012985

(51) Int. Cl.
*B65B 11/08* (2006.01)
*B65B 11/00* (2006.01)
(Continued)

(52) U.S. Cl.
CPC ..... *B65B 11/025* (2013.01); *B65B 11/008* (2013.01); *B65B 65/02* (2013.01); *B65B 2011/002* (2013.01); *B65B 2210/18* (2013.01)

(58) Field of Classification Search
USPC ..... 53/399
See application file for complete search history.

(56) References Cited

U.S. PATENT DOCUMENTS 5,768,862 A 6/1998 Cere
2016/0200470 A1 7/2016 Zoboli
(Continued)

FOREIGN PATENT DOCUMENTS

DE 102017208501 A1 11/2018
EP 3414167 B1 4/2020
IT 202200005261 A1 9/2023

OTHER PUBLICATIONS

International Search Report and Written Opinion issued for International Patent Application No. PCT/IB2023/056029 mailed Jun. 11, 2023.

(Continued)

*Primary Examiner* — Chinyere J Rushing-Tucker
(74) *Attorney, Agent, or Firm* — Merchant & Gould P.C.

(57) ABSTRACT

A machine wrapping bundles with stretch film from a reel with continuous suction includes a ring wrapping machine arranging stretch film around the bundles. The film unwinds from a reel on a rotating ring of the wrapping machine to wrap around bundles, during the passing of the bundles. A pre-stretching group of the stretch film generates an axial deformation of the stretch film. A vacuum box downstream of the pre-stretching group continuously receives the deformed film. The pre-stretching group and vacuum box are arranged on the rotating ring around the bundles. A rotating magnetic track associated with the rotating ring causes a magnetic track wheel/disc to rotate, creating a magnetic transmission having a shaft supported in the pre-stretching group, which actuates a rubber roller on which the film passes. A dynamo connects directly to the magnetic transmission and batteries. A vacuum pump connects to the vacuum box and batteries.

5 Claims, 5 Drawing Sheets

(51) Int. Cl.
*B65B 11/02* (2006.01)
*B65B 65/02* (2006.01)

(56) References Cited

U.S. PATENT DOCUMENTS

| | | | | |
|---|---|---|---|---|
| 2017/0057673 | A1* | 3/2017 | Corberi | B65B 45/00 |
| 2018/0290776 | A1 | 10/2018 | Cere | |
| 2019/0016488 | A1* | 1/2019 | Peccetti | B65B 21/245 |
| 2024/0034500 | A1* | 2/2024 | Juwet | B65B 57/00 |

OTHER PUBLICATIONS

Unpublished Italian Patent Application No. 102022000005261 as filed on Mar. 17, 2022.

* cited by examiner

MACHINE FOR WRAPPING ONE OR MORE BUNDLES WITH STRETCH FILM FROM A REEL WITH CONTINUOUS SUCTION

CROSS-REFERENCE TO RELATED APPLICATIONS

This application is a National Stage Application of PCT/IB2023/056029, filed Jun. 12, 2023, which claims benefit of priority to Italian Patent Application No. 102022000012985 filed on Jun. 20, 2022, and which applications are incorporated herein by reference. To the extent appropriate, a claim of priority is made to each of the above disclosed applications.

FIELD OF THE INVENTION

The present invention relates to a machine for wrapping one or more bundles with stretch film from a reel with continuous suction.

PRIOR ART

Machines that "pack" bundles inside a stretch film are known and used, such as those described in patent EP 3414167, for example.

Such machines belong to the field of packaging bundles and various types thereof have been developed. As is known, in a machine for packaging bundles with a stretch film of this type, there is provided at least one wrapping unit, which arranges the stretch film around one or more bundles by means of at least one ring wrapping machine. Here, the film is taken around the bundle in a known manner and is arranged around it due to the stretching features thereof. In known machines, it is not possible to ensure equal tensioning in every point of the bundle because of the geometric inconsistencies that it has with respect to the angular wrapping linearity that this method produces.

The Applicant of this application has developed a method and an assembly for wrapping one or more bundles with stretch film from a reel which solve such issues and which is the subject of Italian patent application No. 102022000005261 dated 17 Mar. 2022, not yet published.

In this machine, an additional tension control of the film is provided by the arrangement of a vacuum box the effect of which is a tensioning proportional to the absolute value of the vacuum for the surface of the box interfaced with the film.

This vacuum box is supplied by a vacuum pump outside the machine which requires a dynamic manifold system to operate correctly. This is in order to allow the dynamic distribution of the vacuum through a static port outside the machine.

This element is referred to as a vacuum manifold which has technological problems in addition to problems relating to the path, resulting in strong load losses.

SUMMARY OF THE INVENTION

It is the general object of the present invention to provide a solution to these drawbacks of the prior art mentioned above in a highly simple, cost-effective and particularly functional manner.

It is another object of the present invention to provide a machine for wrapping one or more bundles with stretch film from a reel with continuous suction, which does not need to have a vacuum pump outside the wrapping ring with all the resulting connection arrangements, complicated and with complex assembly.

It is another object of the present invention to provide a machine for wrapping one or more bundles with stretch film from a reel with continuous suction.

Last but not least, it is an object of the present invention to identify a machine for wrapping one or more bundles with stretch film from a reel with continuous suction, in which such a suction is independent of whether the wrapping ring arranged therein rotates or not, i.e., independent of the dispensing of film above the bundles.

The aforesaid objects are achieved by a machine for wrapping one or more bundles with stretch film from a reel with continuous suction.

The structural and functional features of the present invention and the advantages thereof with respect to the prior art will become even clearer and more apparent from an examination of the following description, with reference to the accompanying diagrammatic drawings, which show an embodiment of the invention itself.

DETAILED DESCRIPTION OF THE INVENTION

Figure 1:
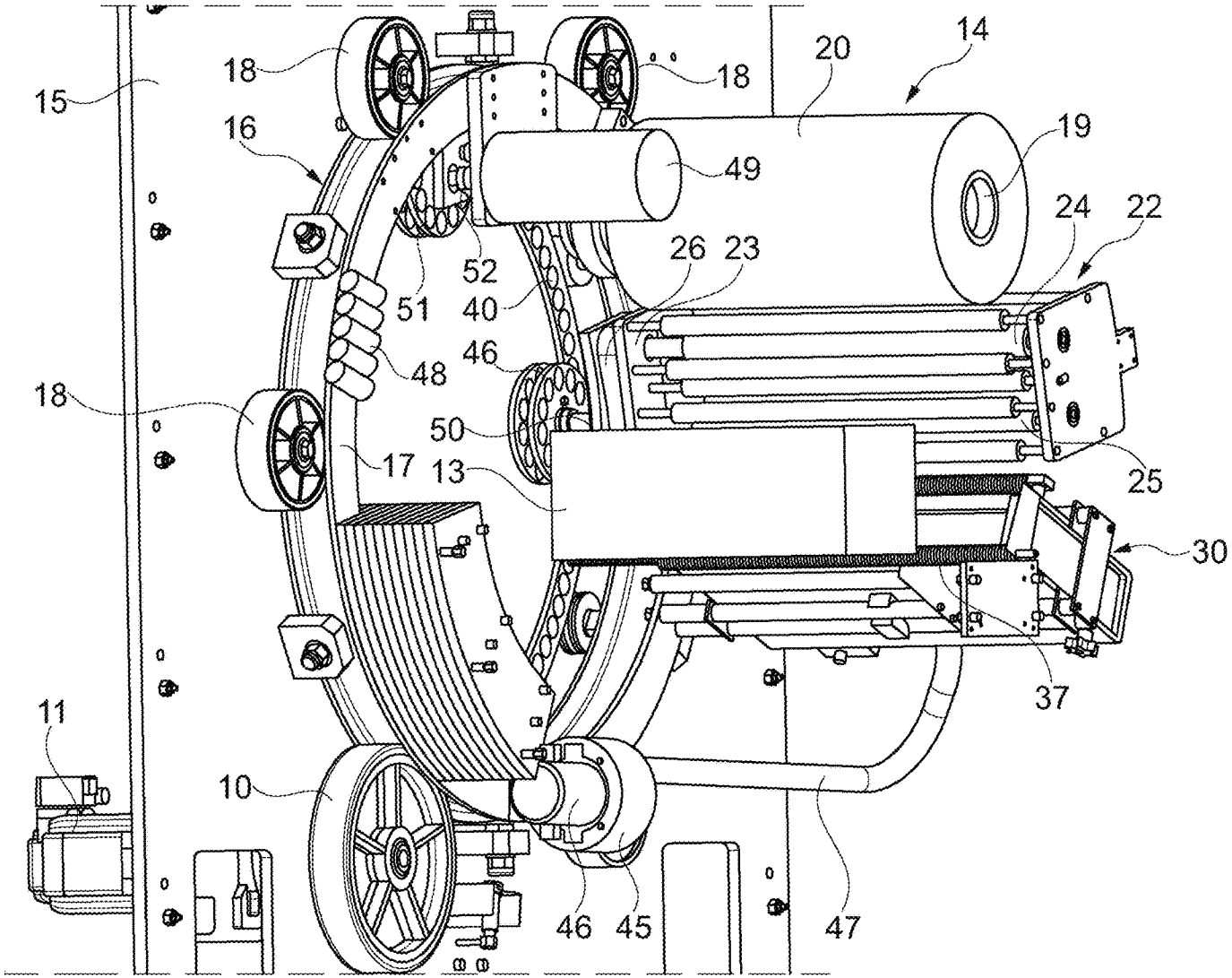
FIG. 1 shows a perspective view of a machine for packaging bundles obtained according to the present invention.
Figure 2:
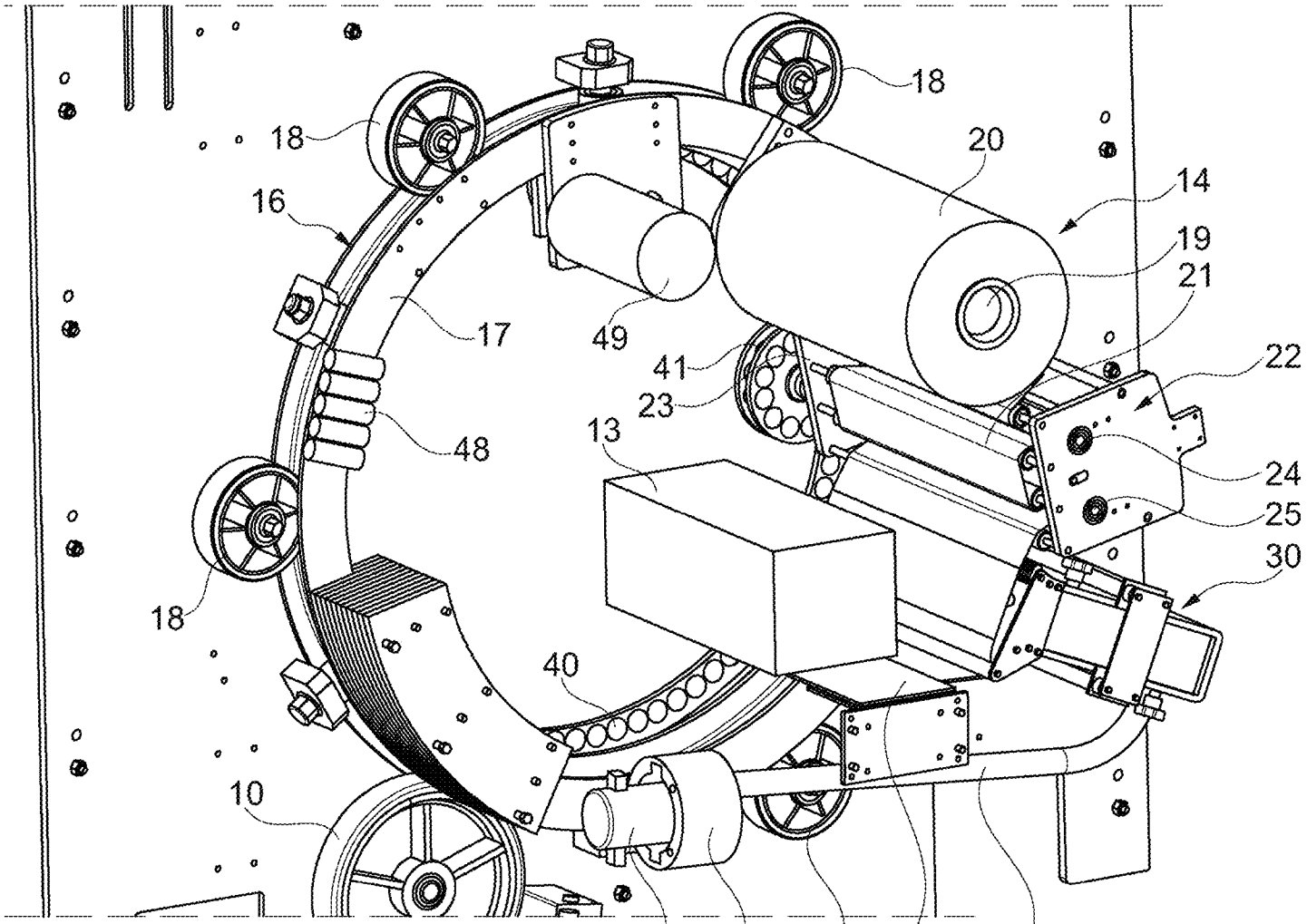
FIG. 2 shows a perspective view from a different angle of the machine shown in FIG. 1, in which the insertion of the film is shown.
Figure 3:
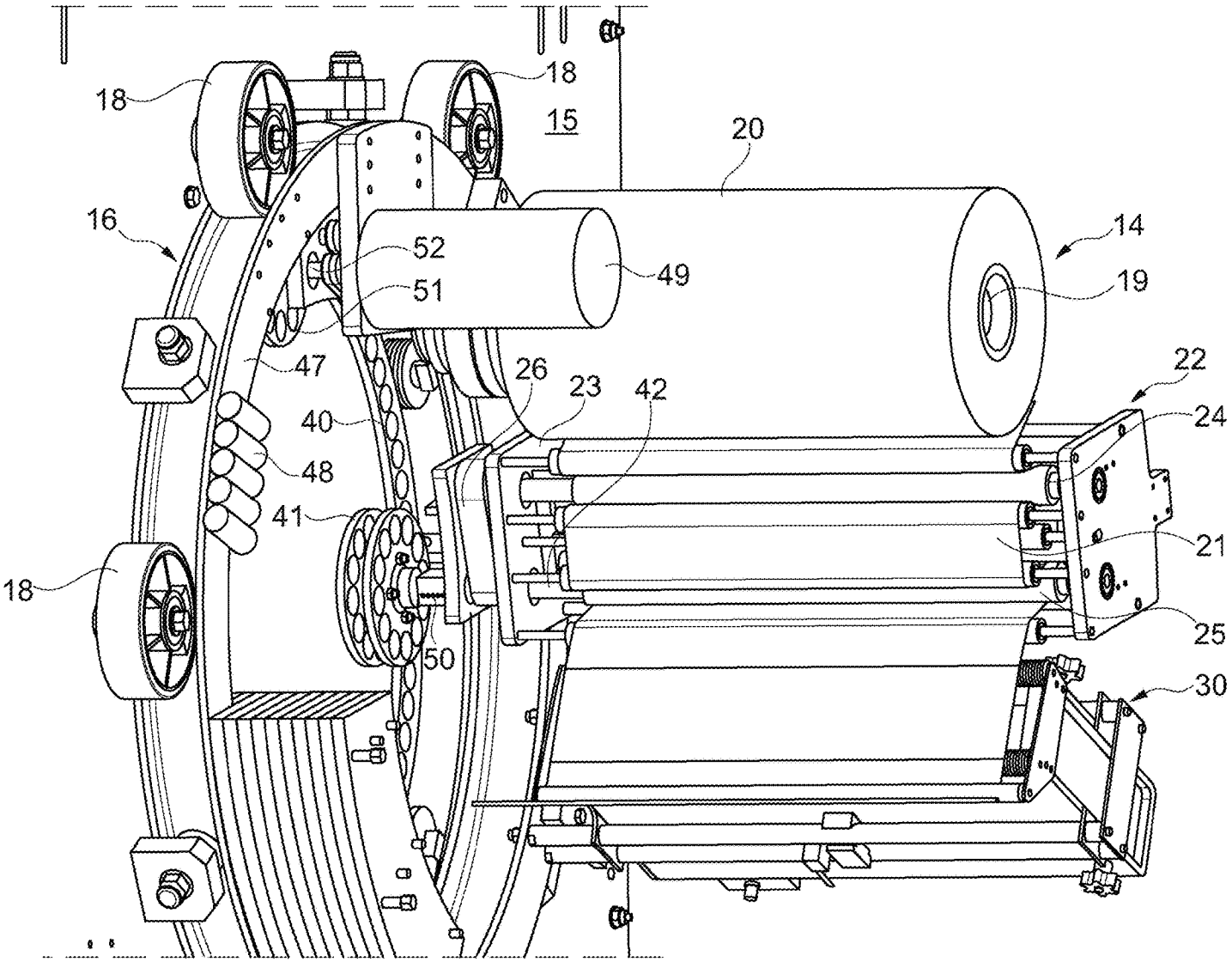
FIG. 3 shows a further perspective view of the machine in FIG. 1.

As usual, in the following description, identical reference numerals for illustrating the figures are used to indicate constructional elements with the same function. Moreover, for illustration clarity, some reference numerals may not be repeated in all the figures.

Indications such as "vertical" and "horizontal", "upper" and "lower" (in the absence of other indications) are to be read with reference to the assembly (or operating) conditions and with reference to the normal terminology used in current language, where "vertical" indicates a direction substantially parallel to that of the gravity force vector "g" and horizontal a direction perpendicular thereto.

With reference to the figures, provided by way of non-limiting examples, an embodiment of a machine for wrapping one or more bundles with stretch film from a reel with continuous suction according to the present invention is shown.

In short, such a machine essentially comprises a wrapping unit (14) comprising a frame (15) which supports at least one ring wrapping machine (16) which operates on bundles (13) moved forward in a known manner on a support surface (37) in a suitable position for wrapping.

Such a ring wrapping machine (16) comprises a ring (17) rotating with respect to guide rollers (18), arranged on the frame (15), for winding the film. Such a rotating ring (17) is arranged in a plane perpendicular to the advancement direction of the bundles and is rotated by a gear motor (11) by means of a friction drive roller (10).

A reel holder (19) for a reel (20) of stretch plastic material film (21) is integrally mounted on the rotating ring (17).

Moreover, a pre-stretching group (22) is arranged downstream of the reel holder (19) with the reel (20), which allows having a constant physical pre-stretching of a dispensed film (21).

Such a pre-stretching group (22), in a non-limiting example thereof, comprises a plate (23) integral with the ring (17). The plate (23) supports the insertion of the stretch film (21) comprising a first driven rubber roller (24) followed at a distance by a second motorized rubber roller (25). In order to allow the correct adhesion of the film to the rollers (24) and (25), the pre-stretching group (23) is equipped with the rollers (24') and (25') in radial and interfering contact with the rollers (24) and (25) to ensure the correct amount of friction required for the film to be homokinetic with the rollers (24) and (25).

The roller (24) and the roller (25) are connected by a mechanical transmission (26) which determines a rotational ratio proportional to the amount of programmed stretching.

At the outlet, downstream of the pre-stretching group (22), a vacuum box (30) serving a buffer function is arranged, thus representing a film tank. This vacuum box (30) is arranged so as to be capable, with its volume, of compensating for the difference between the average enveloping speed of the film (21) during the rotation of the ring (17) and the instantaneous depositing speed the film (21) on a bundle (13). Moreover, the vacuum box (30) is simultaneously capable of depositing the film on the bundle with a tension obtained by adjusting the depressive capacity of the vacuum generating system. The final tension on the one or more wrapped bundles will be the result of the deposition tension and of that due to the elastic return of the film as a result of the pre-stretching imposed by the pre-stretching group (22). The provision of the vacuum box (30), in which the film moves inside the volume thereof, substantially maintains a constant tension equal to the amount of vacuum which is adjusted inside the vacuum box for the surface of the interface section of the box towards the film.

The film (21) exiting from the vacuum box (30) is arranged and directed by rollers which direct it towards the one or more bundles (13).

Moreover, a magnetic track (40) associated with the ring (17) is also arranged, which rotates and causes a magnetic track wheel or disc (41) to rotate, the shaft (42) of which is supported by the plate (23) of the pre-stretching group (22), thus creating a magnetic transmission.

The magnetic track wheel (41) thus motorizes the second rubber roller (25), arranged integral with the shaft (42).

The magnetic track wheel (41) is a satellite disc (or even two discs) which receives motorization through the magnetic track (40) according to speed strategies coherent with the correct amount of extension required for the finished packaging envelope.

Therefore, the pre-stretching group (22) and thus the unwinding of the film (21) are achieved by motorizing the rubber roller (25) of the pre-stretching group with a magnetic track system.

In fact, as mentioned, by rotating at an appropriate speed, the magnetic track (40) rotates the magnetic track wheel (41) fitted onto the same shaft (42) of the pre-stretching rubber roller (25) at the desired speed thus creating the magnetic transmission. The rotation speed of the magnetic track (40) is a function of the rotation speed of the ring (17) of the reel holder, of the average unwinding speed and of any compensations adjusted by the analysis of the amount of film present in the vacuum box which can range between two thresholds from a completely full position to a depleting position.

Moreover, according to the invention, it was decided to arrange a vacuum pump (45) on board the rotating ring (17), appropriately motorized in (46) and connected by a pipe (47) to the vacuum box (30).

A first problem is thus solved, i.e., that of having the wrapping rotating ring (17) which is equipped with a pneumatic-action box, i.e., the vacuum box (30), supplied by a vacuum pump outside the machine.

Therefore, the presence of a dynamic manifold system which is capable of allowing the dynamic distribution of the vacuum by means of a static port outside the machine is avoided.

For the motorized pump (45), a 36 Volt motor is applied, for example, with a very good suction capacity which is sufficient for the requirements of the vacuum box (30).

Such a motor (46) is supplied by lithium batteries, diagrammatically indicated in (48) on board the rotating ring (17) too.

Since the machine usually is a machine generally operating intermittently and not continuously, this means that the vacuum system must operate and be active even when the machine is stopped in order to keep the film in place for correctly starting the subsequent wrapping.

In order to keep this active and powered, or rather to keep the batteries (48) effective so that they do not wear out, according to the present invention a dynamo (49) is also used on board the rotating ring (17).

Such a dynamo (49) is directly connected to the magnetic track (40) taking advantage of the magnetic transmission previously set out and already used for unwinding the film.

Therefore, during the rotation of the rotating ring (17), the dynamo (49) is capable of recharging and regenerating the batteries (48) which are simultaneously powering the electric motor (46) of the vacuum pump (45).

It has also been noted according to the present invention that with the operation indicated above, the rotating ring (17) is actuated discontinuously, i.e., the rotating ring rotates for three, four or five revolutions according to the wrapping strategy, and then it stops for an amount of time of the order of some tens of seconds before starting to operate again.

This aspect implies that, since the motor (46) of the vacuum pump (45) is a continuously operated motor, the alternating operation can lead to not having a guaranteed, certain proper charging of the batteries (48).

Hence, it was decided to "engage" the dynamo (49) constrained to the movable rotating ring (17) in a permanent manner (FIG. 1), unlike the transmission of the dispensing of the film selectively engaged with the magnetic transmission mentioned above, so as to intervene to disengage the film supply.

More precisely, precisely from FIG. 1 it can be seen how the dynamo (49) extends a shaft (52) thereof to support a magnetic track wheel (51) fitted onto the same shaft (52). The magnetic track wheel (51) cooperates with the magnetic track (40) of the rotating ring (17).

The magnetic transmission is thus independent with respect to the movement of the movable rotating ring (17) and at this point it is possible to keep the magnetic transmission active even when the rotating ring (17) is stopped so as to supply the tachometric dynamo (49).

In the arrangement described so far, the magnetic transmission is also connected to the main transmission element thereof, i.e., the motorized rubber roller (25) and the radially contacting roller (25') which drives the dispensing of the film (21) from the reel (20).

Therefore, when the rotating ring (17) is stopped, the film (21) needs to be absolutely stopped, otherwise it unwinds the film and there is nowhere to deposit it as it must be unwound in the amount needed to wrap the bundle around the ideal perimeter thereof.

Therefore, according to the present invention, in order to solve this problem too and have thus possibility of continuous operation, a selective engagement-disengagement group has been arranged on the machine.

Figure 4:
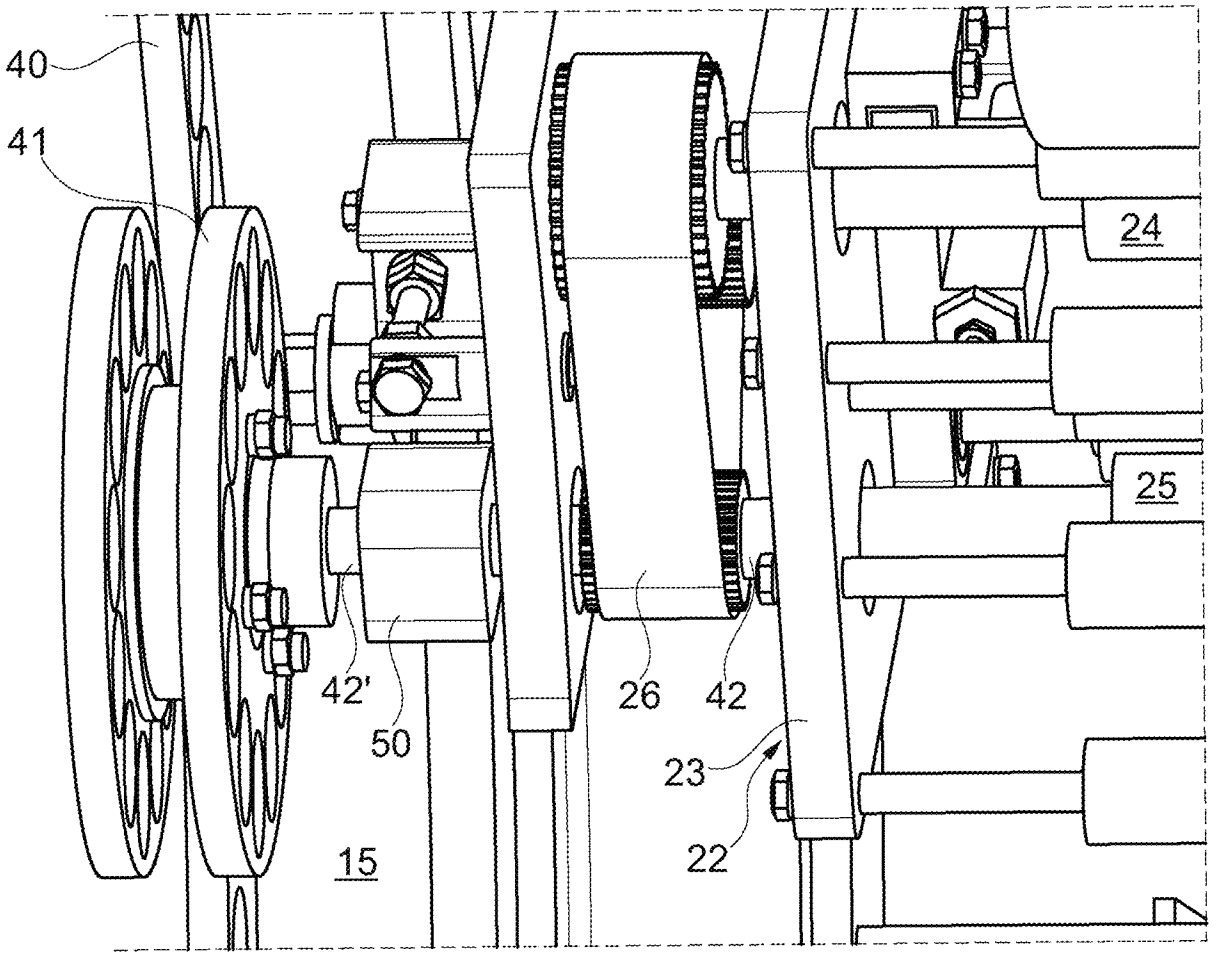
FIG. 4 shows a perspective view of an enlarged detail of a part of the machine according to the invention close to a brake-clutch group.
Figure 5:
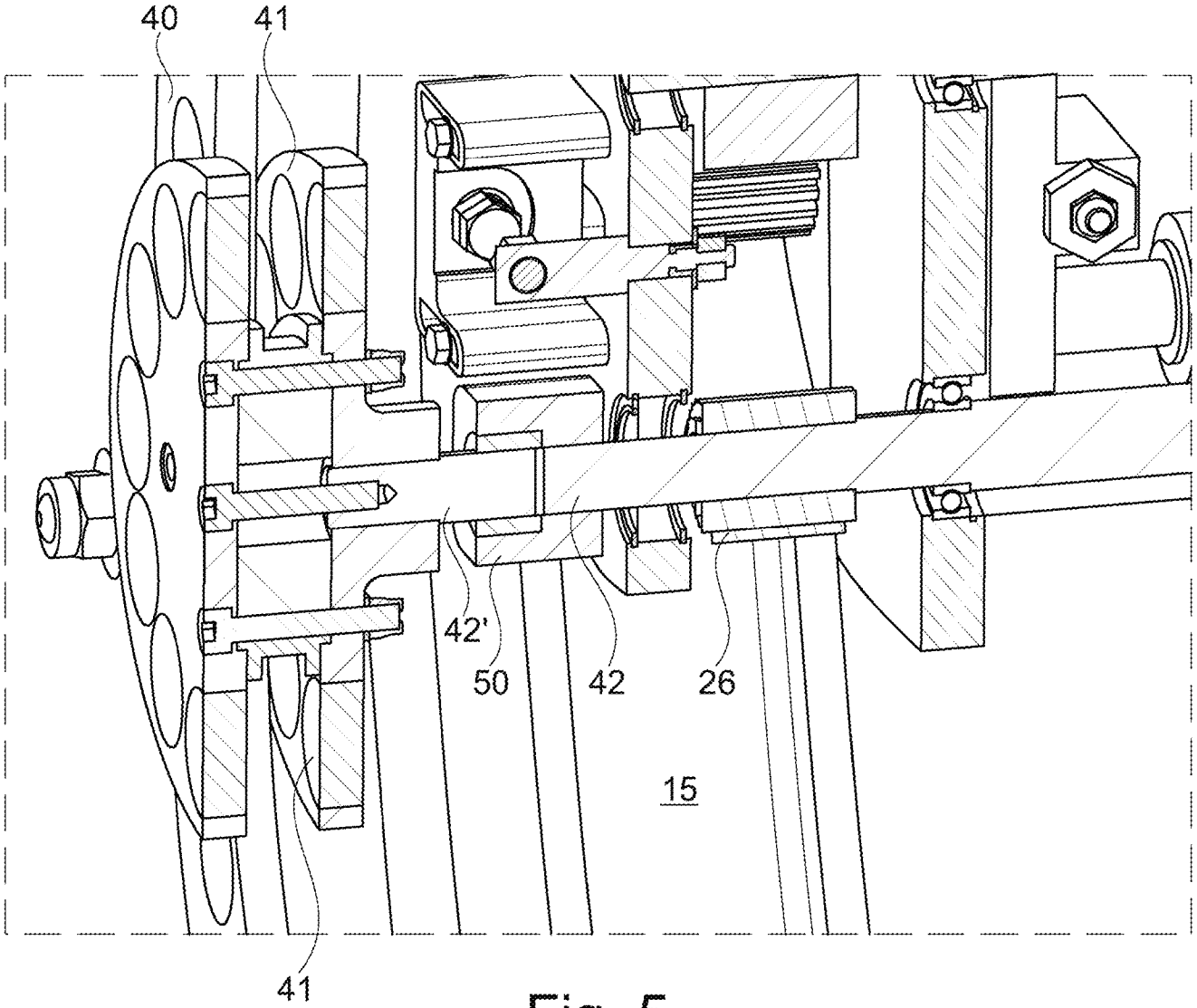
FIG. 5 shows a perspective view from another angle of the view in FIG. 4 in a partially sectioned view.

In fact, a selective engagement-disengagement group such as a brake-clutch (50) group, for example, has been arranged between the magnetic track wheel or disc (41) and the shaft (42) which selective engagement-disengagement group drives the dispensing of the film (21) from the reel (20), which allows the magnetic transmission to be selectively separated from the film pulling group, i.e., the motorized rubber roller (25) and the radially contacting roller (25') (FIGS. 4 and 5). It is seen how the brake-clutch group (50) of the embodiment receives, on the one hand, the shaft (42) for driving the dispensing of the film (21) from the reel (20), and on the other hand, a shaft (42') supporting the magnetic track wheel or disc (41). It is thus possible to act selectively to engage or disengage the movement of the motorized rubber roller (25) and therefore the unwinding of the film.

It is thus possible to free the unwinding of the film from the rotation of the rotating ring (17) while keeping the motion independent of the magnetic transmission active.

This allows the dynamo (49) to be kept in motion, which even when the rotating ring (17) is stopped, continues to generate current for powering the batteries (48).

At the same time, an uncoupling of the main transmission on the dispensing of the film with respect to the magnetic transmission is created so that the film stops and is not dispensed from the reel when the ring is stopped.

The strategic combination of the action of the brake clutch group (50) with the magnetic transmission (40, 41) for driving the dispensing of the film, rather than the static nature or movement of the movable ring, instead of the continuity of motion given to the magnetic transmission, allows both the predetermined punctual dispensing of the film according to the amount desired by the program and project, and the continuous supply of current in order to continue to supply power, when the rotating wrapping structure is stopped, to the part of power supply of the motor on board the vacuum box which determines the vacuum because it is powered by batteries on board too.

Therefore, the advantages determined by a machine according to the present invention are apparent.

It is also clear that one of the most important aspects lies in that this type of application, i.e., the fact of having a dynamo that recharges the batteries by utilizing the magnetic transmission of the previous application, allows providing a motor system on board the rotating ring of the machine rather than having remote systems on the ground and transferring power supplies or transmissions by means of the transmission joints.

The difference between the continuous machine and the non-continuous machine is that there is no need for the selective brake-clutch group.

The invention claimed is:

1. A machine for wrapping one or more bundles with stretch film from a reel with continuous suction comprising:

at least one wrapping unit including at least one ring wrapping machine which, on rotating, arranges stretch film around the one or more bundles, wherein said film is unwound from a reel arranged on a rotating ring of said ring wrapping machine and is caused to be arranged around one or more bundles, during transiting of the bundles in the wrapping unit, a pre-stretching group of the stretch film which generates an axial deformation of said stretch film which is being unwound from said reel and is passed through said pre-stretching group, a vacuum box which continuously receives said stretch film having said axial deformation generated in the pre-stretching group, wherein said vacuum box has a volume within which the film moves and keeps the axial deformation generated in said pre-stretching group as said stretch film passes forwards inside the vacuum box substantially constant, wherein said vacuum box is arranged downstream of said pre-stretching group and both the pre-stretching group and the vacuum box are arranged on said rotating ring around said one or more bundles, a magnetic track which is associated with said rotating ring and rotates and causes a wheel or disc to rotate with a magnetic track, which create a magnetic transmission, the shaft of said wheel or disc with a magnetic track is supported in said pre-stretching group and actuates at least one rubberized roller on which said film passes, a dynamo on board the rotating ring connected directly to the magnetic transmission and connected to batteries, a vacuum pump motorized in on board the rotating ring connected to the vacuum box and to said batteries.

2. The machine according to claim 1, comprising a selective engagement-disengagement group between said magnetic track of said magnetic transmission and said drive shaft of the pre-stretching group.

3. The machine according to claim 2, wherein said selective engagement-disengagement group comprises a brake-clutch group which selectively separates the magnetic track of said magnetic transmission from the drive shaft of the motorized rubber roller of the pre-stretching group.

4. The machine according to claim 3, wherein said brake-clutch group receives, on one side, the shaft for controlling the supply of the film from the reel and, on the other side, a shaft that supports said wheel or disc with a magnetic track.

5. The machine according to claim 1, wherein a shaft extends from said dynamo to support a wheel with a magnetic track which is fitted onto the shaft extending from said dynamo, and which collaborates with the magnetic track of the rotating ring.

* * * * *